US010421634B2

(12) United States Patent
Ushiama

(10) Patent No.: US 10,421,634 B2
(45) Date of Patent: Sep. 24, 2019

(54) MEDIUM FEEDING APPARATUS

(71) Applicant: SEIKO EPSON CORPORATION, Tokyo (JP)

(72) Inventor: Jun Ushiama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 142 days.

(21) Appl. No.: 15/454,368

(22) Filed: Mar. 9, 2017

(65) Prior Publication Data

US 2017/0275118 A1 Sep. 28, 2017

(30) Foreign Application Priority Data

Mar. 23, 2016 (JP) ..... 2016-058112

(51) Int. Cl.
*B65H 23/185* (2006.01)
*B41J 13/00* (2006.01)

(52) U.S. Cl.
CPC ..... *B65H 23/185* (2013.01); *B41J 13/0009* (2013.01); *B65H 2513/11* (2013.01); *B65H 2515/31* (2013.01); *B65H 2801/12* (2013.01)

(58) Field of Classification Search
CPC ..... B65H 23/185; B41J 13/0009
See application file for complete search history.

(56) References Cited

U.S. PATENT DOCUMENTS 8,936,339 B2 * 1/2015 Horie ..... B41J 11/007 347/104
2012/0056927 A1 * 3/2012 Mitsuhashi ..... B65H 23/185 347/16
2016/0340140 A1 * 11/2016 Onodera ..... B65H 23/1806

FOREIGN PATENT DOCUMENTS

JP 2009-208921 A 9/2009

* cited by examiner

*Primary Examiner* — Sang K Kim
(74) *Attorney, Agent, or Firm* — Workman Nydegger

(57) ABSTRACT

A medium feeding apparatus includes a roll motor which applies torque for rotating a roll body to the roll body, a storage portion which stores output measured value, which is measurement result of output value to the roll motor for rotating the roll body, and a roll control portion which corrects the output measured values stored in the storage portion to correction value in accordance with stop time of the roll motor, and controls the roll motor based on the corrected output measured values.

3 Claims, 11 Drawing Sheets

FIG. 9

150

| STOP TIME | FIRST CORRECTION VALUE | SECOND CORRECTION VALUE |
|---|---|---|
| LESS THAN 1.0 h | -8 | -17 |
| LESS THAN 2.0 h | -14 | -26 |
| LESS THAN 3.0 h | -18 | -30 |
| LESS THAN 4.0 h | -19 | -31 |
| LESS THAN 5.0 h | -21 | -32 |
| LESS THAN 6.0 h | -21 | -32 |
| LESS THAN 7.0 h | -22 | -32 |
| EQUAL TO OR LONGER THAN 7.0 h | -23 | -33 |

FIG. 10

150a

| STOP TIME | LESS THAN W [kg] | | EQUAL TO OR MORE THAN W [kg] | |
|---|---|---|---|---|
| | FIRST CORRECTION VALUE | SECOND CORRECTION VALUE | FIRST CORRECTION VALUE | SECOND CORRECTION VALUE |
| LESS THAN 1.0 h | -8 | -17 | -10 | -19 |
| LESS THAN 2.0 h | -14 | -26 | -16 | -28 |
| LESS THAN 3.0 h | -18 | -30 | -20 | -32 |
| LESS THAN 4.0 h | -19 | -31 | -21 | -34 |
| LESS THAN 5.0 h | -21 | -32 | -24 | -35 |
| LESS THAN 6.0 h | -21 | -32 | -24 | -35 |
| LESS THAN 7.0 h | -22 | -32 | -25 | -35 |
| EQUAL TO OR LONGER THAN 7.0 h | -23 | -33 | -26 | -36 |

FIG. 11

150b

| STOP TIME | LESS THAN t [°C] | | EQUAL TO OR MORE THAN t [°C] | |
|---|---|---|---|---|
| | FIRST CORRECTION VALUE | SECOND CORRECTION VALUE | FIRST CORRECTION VALUE | SECOND CORRECTION VALUE |
| LESS THAN 1.0 h | -8 | -17 | -9 | -18 |
| LESS THAN 2.0 h | -14 | -26 | -15 | -27 |
| LESS THAN 3.0 h | -18 | -30 | -19 | -31 |
| LESS THAN 4.0 h | -19 | -31 | -20 | -32 |
| LESS THAN 5.0 h | -21 | -32 | -22 | -33 |
| LESS THAN 6.0 h | -21 | -32 | -22 | -33 |
| LESS THAN 7.0 h | -22 | -32 | -23 | -33 |
| EQUAL TO OR LONGER THAN 7.0 h | -23 | -33 | -24 | -34 |

MEDIUM FEEDING APPARATUS

BACKGROUND

1. Technical Field

The present invention relates to a medium feeding apparatus which feeds a medium from a roll body around which the medium is wound.

2. Related Art

An ink jet printer which is an example of a medium feeding apparatus will be described as an example. Among these ink jet printers, an ink jet printer is known, which is provided with a spindle motor applying torque for rotating a roll body to the roll body and a torque control device controlling the spindle motor. The torque control device measures a current value being output to the spindle motor for rotating the spindle motor by operating the spindle motor. Also, based on a measured result of the current value, a setting torque of the spindle motor is set (refer to JP-A-2009-208921).

In the medium feeding apparatus, there is a case in which load being applied to a roll driving portion, characteristics of the roll driving portion, or the like, at the time of rotating the roll body is changed in a stop period of the roll driving portion, and as a result, output values to the roll driving portion for rotating the roll body are changed. In this case, even in a case where, after the stop period of the roll driving portion, the roll driving portion is controlled using the output measured values which are measurement result of the output values to the roll driving portion for rotating the roll body, and are measured before the stop period of the roll driving portion, the roll driving portion cannot be appropriately operated. In addition, after the roll driving portion is stopped, measuring again of the output value to the roll driving portion takes time and efforts.

SUMMARY

An advantage of some aspects of the invention is to provide a medium feeding apparatus which is capable of appropriately operating a roll driving portion, even in a case in which output values to a roll driving portion for rotating a roll body is changed in a stop period of the roll driving portion, without measuring the output value to the roll driving portion again.

The medium feeding apparatus according to an aspect of the invention includes a roll driving portion that applies torque for rotating a roll body to the roll body, a storage portion that stores output measured value which is measurement result of output value to the roll driving portion for rotating the roll body, and a roll control portion that corrects the output measured values stored in the storage portion to correction value in accordance with stop time of the roll driving portion, and controls the roll driving portion based on the corrected output measured values.

According to the configuration, the output measured values stored in the storage portion are corrected to the correction values in accordance with the stop time of the roll driving portion. Accordingly, the output measured value stored in the storage portion can be come up to the output measured value obtained in a case of being measured after the stop period of the roll driving portion is finished. Therefore, even in a case in which the output value to the roll driving portion for rotating the roll body in the stop period of the roll driving portion is changed, the roll driving portion can be appropriately operated without measuring the output value to the roll driving portion again.

In this case, it is preferable that the storage portion store a plurality of the output measured values for rotating the roll body at each different rotation speed, and the roll control portion change the correction values in accordance with the rotation speed of the roll body.

According to the configuration, each output measured value stored in the storage portion is corrected to a correction value in accordance with the rotation speed of the roll body. Accordingly, even in a case in which a change range of the output value to the roll driving portion for rotating the roll body, which is changed in the stop period of the roll driving portion, differs according to the rotation speed of the roll body, each output measured value stored in the storage portion can be come up to the output measured value obtained in a case of being measured after the stop period of the roll driving portion is finished.

In this case, it is preferable that the roll control portion change the correction values in accordance with the weight of the roll body.

According to the configuration, the output measured value stored in the storage portion is corrected to the correction value in accordance with the weight of the roll body. Accordingly, even in a case in which the change range of the output value to the roll driving portion for rotating the roll body, which is changed in the stop period of the roll driving portion, differs in accordance with the weight of the roll body, output measured value stored in the storage portion can be come up to the output measured value obtained in a case of being measured after the stop period of the roll driving portion is finished.

In this case, it is preferable that the roll control portion change the correction values in accordance with an amount of change of temperature of the roll driving portion after the output measured values are measured.

According to the configuration, the output measured value stored in the storage portion is corrected to the correction value in accordance with the amount of change of temperature of the roll driving portion. Accordingly, even in a case in which the change range of the output value to the roll driving portion for rotating the roll body, which is changed in the stop period of the roll driving portion, differs in accordance with the amount of change of temperature of the roll driving portion, output measured value stored in the storage portion can be come up to the output measured value obtained in a case of being measured after the stop period of the roll driving portion is finished.

BRIEF DESCRIPTION OF THE DRAWINGS

The invention will be described with reference to the accompanying drawings, wherein like numbers reference like elements.

FIG. 9 is a table illustrating a correction value table.

FIG. 10 is a table illustrating a correction value table of a first modification example.

FIG. 11 is a table illustrating a correction value table of a second modification example.

DESCRIPTION OF EXEMPLARY EMBODIMENTS

Hereinafter, a recording apparatus 10 which is an embodiment of a medium feeding apparatus of the invention will be described with reference to attached drawings.

Figure 1:
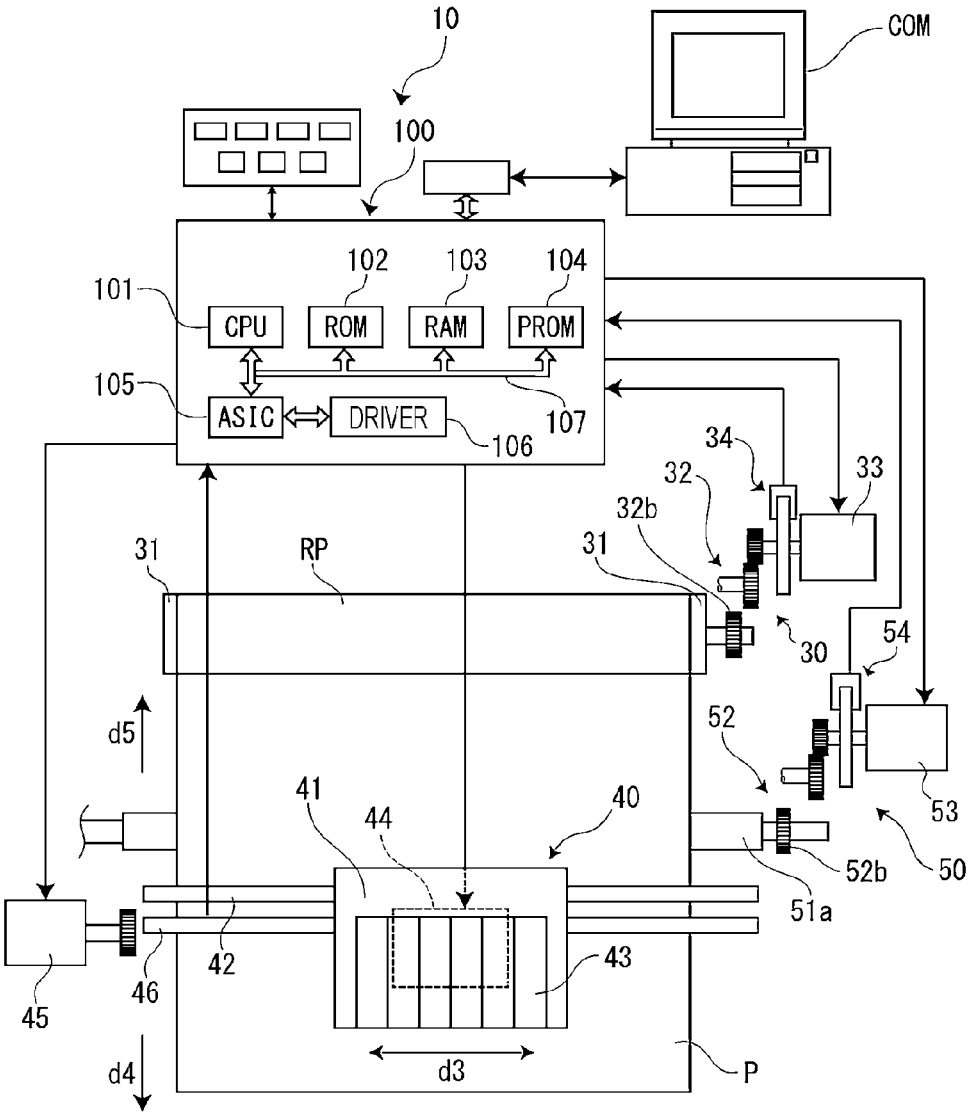
FIG. 1 is a view illustrating a schematic configuration of a recording apparatus according to an embodiment of the invention.
Figure 2:
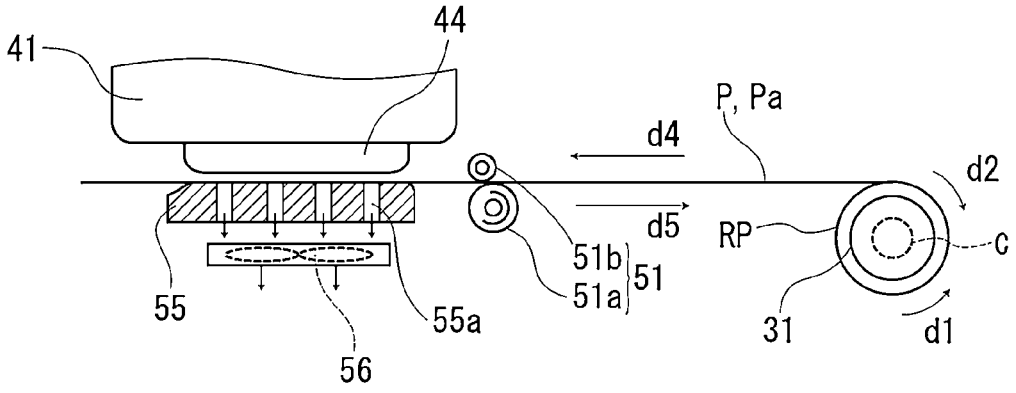
FIG. 2 is a view illustrating a position relationship of a roll body, a feeding roller, and a recording head.

Based on FIG. 1 and FIG. 2, a schematic configuration of the recording apparatus 10 will be described. The recording apparatus 10 prints an image by an ink jet manner with respect to a medium P while the medium P is unwound from a roll body RP. In addition, the roll body RP set in the recording apparatus 10 is a roll body in which the long shaped medium P is wound around the core C (for example, paper tube). Also, as the medium P, for example, various materials such as paper, films, and fabrics are used. A maximum width, a maximum diameter, a maximum weight of the roll body RP which can be set in the recording apparatus 10 are respectively, for example, 64 inches (substantially 1.6 m), 250 mm, and 80 kg.

The recording apparatus 10 is provided with a roll driving mechanism 30, a carriage driving mechanism 40, a medium feeding mechanism 50, a platen 55, and a controller 100.

The roll driving mechanism 30 rotates the roll body RP. The roll driving mechanism 30 is provided with a pair of rotation holders 31, a roll gear train 32, a roll motor 33, and a roll rotation detecting portion 34.

The pair of rotation holders 31 is inserted into both ends of the core C of the roll body RP, and held by the both ends of the roll body RP. The rotation holder 31 is supported to be capable of being rotated by a holder supporting portion which is not illustrated. In one rotation holder 31, the roll inputting gear 32*b*, which is engaged with a roll outputting gear (not illustrated) of the roll gear train 32, is provided.

The roll motor 33 applies torque for rotating the roll body RP to the roll body RP through the rotation holder 31. As the roll motor 33, for example, a direct current (DC) motor can be used. In a case in which a driving force from the roll motor 33 is transferred to the rotation holder 31 through the roll gear train 32, the rotation holder 31 and the roll body RP held by the rotation holder 31 are rotated. In a case in which the roll motor 33 is rotated in a one reverse direction, the roll body RP is rotated in an unwinding direction d1 so that the medium P is unwound from the roll body RP. In addition, in a case in which the roll motor 33 is rotated in another reverse direction, the roll body RP is rotated in a rewinding direction d2 so that the medium P is rewound to the roll body RP.

The roll rotation detecting portion 34 detects a rotation amount of the roll body RP. The roll rotation detecting portion 34 is a rotary encoder which includes a disk shaped scale provided on an output shaft of the roll motor 33 and a photo-interrupter. As a counter value of an output pulse from the roll rotation detecting portion 34, a rotation position of the roll body RP is shown, and an amount of change of the rotation position of the roll body RP is set to the rotation amount of the roll body RP.

The carriage driving mechanism 40 reciprocates a carriage in which the recording head 44 is mounted 41 in a movement direction d3. The carriage driving mechanism 40 is provided with the carriage 41, a carriage shaft 42, a carriage motor 45, and a carriage position detecting portion 46.

The carriage 41 is supported by the carriage shaft 42 so as to be movable along the carriage shaft 42. In the carriage 41, and ink tanks 43 of a plurality of colors are provided. In the ink tank 43, ink is supplied from the ink cartridge which is not illustrated through a tube. In addition, on a lower surface of the carriage 41, the recording head 44 which is an ink jet head is provided. The recording head 44 discharges the ink from nozzles with respect to the medium P.

The carriage motor 45 is a driving source for moving the carriage 41 along the carriage shaft 42 in the movement direction d3. In a case in which a driving force of the carriage motor 45 is transferred to the carriage 41 through a belt mechanism which is not illustrated, the carriage 41 is moved in the movement direction d3.

The carriage position detecting portion 46 detects a position in the movement direction d3 of the carriage 41. The carriage position detecting portion 46 is a linear encoder which is provided with a linear scale provided along the movement direction d3 and a photo-interrupter.

The medium feeding mechanism 50 feeds the medium P unwound from the roll body RP. The medium feeding mechanism 50 is provided with a feeding roller 51, a feeding gear train 52, a feeding motor 53, and a feeding rotation detecting portion 54.

The feeding roller 51 is provided with a driving roller 51*a* and an accompanied roller 51*b*. The driving roller 51*a* and the accompanied roller 51*b* feed the medium P sandwiched between each other. In the driving roller 51*a*, a feeding inputting gear 52*b* engaged with a feeding outputting gear (not illustrated) of the feeding gear train 52 is provided.

The feeding motor 53 is a driving source for rotating the driving roller 51*a*. The feeding motor 53 is, for example, a DC motor. When a driving force from the feeding motor 53 is transferred to the driving roller 51*a* through the feeding gear train 52, the driving roller 51*a* is rotated, according to this, the accompanied roller 51*b* is rotated. When the feeding motor 53 is rotated in the one reverse direction, the medium P is fed in a feeding direction d4 substantially orthogonal to the movement direction d3. In addition, when the feeding motor 53 is rotated in another reverse direction, the medium P is fed in the reverse-feeding direction d5 which is reversed direction of the feeding direction d4.

The feeding rotation detecting portion 54 detects a rotation amount of the driving roller 51*a*. The feeding rotation detecting portion 54 is a rotary encoder which includes a disk shaped scale provided on an output shaft of the feeding motor 53 and a photo-interrupter. As a counter value of an output pulse from the feeding rotation detecting portion 54, a rotation position of the driving roller 51*a* is shown, and an amount of change of the rotation position of the driving roller 51*a* is set to a rotation amount of the driving roller 51*a*.

The platen 55 is provided to face the recording head 44 in a downstream side of a feeding passage Pa further than the driving roller 51*a*. In the platen 55, a plurality of suction holes 55*a* vertically penetrating the platen are formed. In addition, a suction fan 56 is formed on a lower side of the platen 55. When the suction fan 56 is operated, an inside of the suction hole 55*a* is negatively pressurized, and the medium P on the platen 55 is sucked and held. Ink is discharged from the recording head 44 with respect to the medium P sucked and held on the platen 55.

The controller 100 controls each portion of the recording apparatus 10 overall. The controller 100 is provided with a central processing unit (CPU) 101, a read only memory (ROM) 102, a random access memory (RAM) 103, a programmable ROM (PROM) 104, an application specific integrated circuit (ASIC) 105, a motor driver 106, and a bus 107. The motor driver 106 is driven by pulse width modulation (PWM)-controlling the roll motor 33 and the feeding motor 53. The functional configuration of the controller 100 will be described later.

In addition, the controller 100 is connected to be capable of communicating with a computer COM which is an external device. The controller 100 controls each portion of the recording apparatus 10 based on a received recording job when receiving the recording job from the computer COM. Accordingly, the recording apparatus 10 alternately repeats a dot forming operation and the feeding operation. Here, the dot forming operation is an operation in which ink is discharged from the recording head 44 and forms dots on the medium P while the carriage 41 is moved in the movement direction d3, and it is called a main scanning. The feeding operation is an operation in which the medium P is fed in the feeding direction d4, and it is called a sub scanning.

Figure 3:
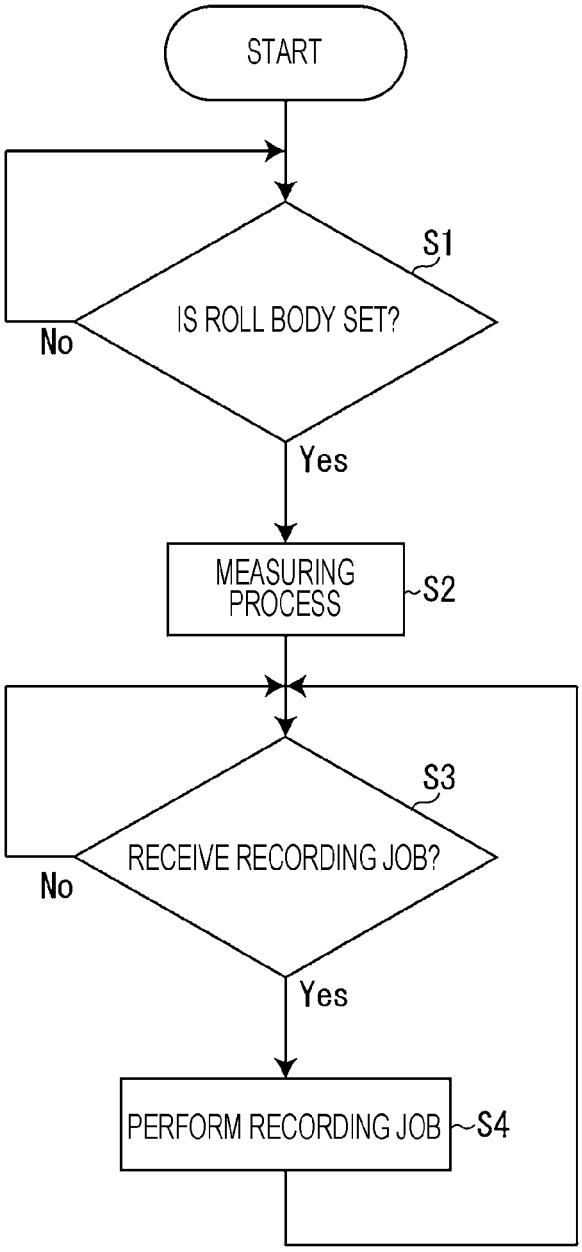
FIG. 3 is a flow chart illustrating flowing of the entire process of the recording apparatus.

Based on FIG. 3, flowing of a basic process in the recording apparatus 10 will be described. In Step S1, the controller 100 determines whether or not the roll body RP is set in the recording apparatus 10. The controller 100 may determine whether or not the roll body RP is set in the recording apparatus 10, for example, based on an operation with respect to an operation panel which is not illustrated, or based on a detected result by a sensor which is not illustrated. The controller 100 proceeds a progress to Step S2, when determining that the roll body RP is set in the recording apparatus 10 (Yes in S1).

In Step S2, the controller 100 performs a measuring process. In the measuring process, a roll diameter Rr, a first duty value D1, and a second duty value D2 are measured. The roll diameter Rr is a radius of the roll body RP. The first duty value D1 is a rotation duty value for rotating the roll body RP at a first rotation speed V1. The rotation duty value means a duty value for PWM controlling being output to the roll motor 33 for rotating the roll body RP. The second duty value D2 is a rotation duty value for rotating the roll body RP at a second rotation speed V2 faster than the first rotation speed V1. A measuring method of the roll diameter Rr, the first duty value D1, and the second duty value D2 will be described later. When the measuring process is finished, the measured roll diameter Rr, first duty value D1, and second duty value D2 are stored in a storage portion 140 (refer to FIG. 4). That is, the storage portion 140 stores the first duty value D1 and the second duty value D2 as a detection result of two rotation duty values corresponding to each of the different rotation speed. The storage portion 140 is configured with, for example, a PROM 104.

In Step S3, the controller 100 determines whether or not the recording job is sent from the computer COM. The controller 100 proceeds the progress to Step S4 when determining that the recording job is sent from the computer COM (Yes in S3).

In Step S4, the controller 100 performs the recording job. Detail will be described later, the controller 100 controls the roll motor 33 based on the roll diameter Rr, the first duty value D1, and the second duty value D2 stored in the storage portion 140, at the time of the feeding operation in the recording job. When the recording job is finished, the progress returns to Step S3.

Here, the measuring method of the roll diameter Rr, the first duty value D1, and the second duty value D2 will be described. First, the controller 100 operates only the feeding motor 53, in a state in which the medium P is not slacked, without operating the roll motor 33. In a case in which the medium P is fed as described above, it is thought that a feeding amount of the medium P by the feeding roller 51, and a feeding amount of the medium P unwound from the roll body RP which is pulled and rotated by the feeding roller 51 through the medium P are equal to each other. Therefore, the controller 100 calculates the roll diameter Rr based on a rotation amount of the driving roller 51*a* detected by the feeding rotation detecting portion 54, a diameter of the driving roller 51*a* which is known, and a rotation amount of the roll body RP detected by the roll rotation detecting portion 34.

Subsequently, the controller 100 operates the roll motor 33 so that the roll body RP is rotated in the unwinding direction d1 at the first rotation speed V1. The controller 100 acquires a duty value being output to the roll motor 33 as the first duty value D1 at the time when the rotation speed V of the roll body RP is stabled at the first rotation speed V1. Subsequently, the controller 100 operates the roll motor 33 so that the roll body RP is rotated in the unwinding direction d1 at the second rotation speed V2. The controller 100 acquires a duty value output to the roll motor 33 as the second duty value D2 at the time when the rotation speed V of roll body RP is stabled at the second rotation speed V2.

Moreover, the roll diameter Rr is reduced in accordance with feeding of the medium P when the recording job is performed. Therefore, it is preferable that the controller 100 corrects the roll diameter Rr recorded in the storage portion 140 in a second or later recording job after the roll body RP is set, based on a feeding amount of the medium P in a previous recording job. In addition, the first duty value D1 and the second duty value D2 has a corresponding relationship with the roll diameter Rr. Therefore, it is preferable that the controller 100 correct the first duty value D1 and the second duty value D2 recorded in the storage portion 140 in a second or later recording job after the roll body RP is set, based on the corrected roll diameter Rr. Further, the controller 100 may correct the roll diameter Rr, the first duty value D1, and the second duty value D2 in real time during performing the recording job.

Figure 4:
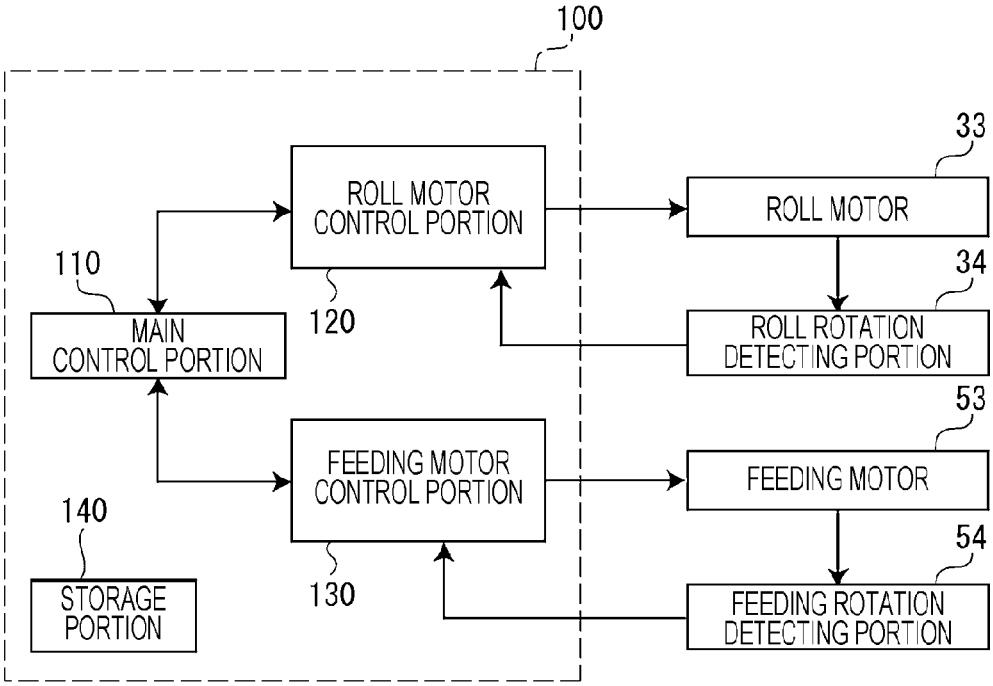
FIG. 4 is a block diagram illustrating a functional configuration of a controller.

Based on FIG. 4, the functional configuration of the controller 100 will be described. The controller 100 is provided with a main control portion 110, a roll motor control portion 120, a feeding motor control portion 130, and a storage portion 140. Each functional portion illustrated in FIG. 4 and FIG. 6 to be described later is realized when a hardware constituting the controller 100 is cooperated with a software stored in a memory such as the ROM 102.

The main control portion 110 gives a command to the roll motor control portion 120 and the feeding motor control portion 130. The main control portion 110 is capable of giving commands to the roll motor control portion 120 and the feeding motor control portion 130 so that the roll motor 33 and the feeding motor 53 are respectively and independently driven, and the roll motor 33 and the feeding motor 53 are driven to be synchronized.

The feeding motor control portion 130 performs a speed PID control in a front converting position as a predetermined amount further than a target stop position, at the time of the feeding operation, and after reaching the converting position, the controller performs a position PID control. The feeding motor control portion 130 controls the feeding motor 53 at the time of the speed PID control based on a speed deviation of the rotation speed (current speed) and a target speed which are calculated from a rotation position of the driving roller 51*a* detected by the feeding rotation detecting portion 54. In addition, the feeding motor control portion 130 controls the feeding motor 53 at the time of the position PID control based on a position deviation of a rotation position (current position) and a target stop position of the driving roller 51*a* detected by the feeding rotation detecting portion 54.

Figure 5:
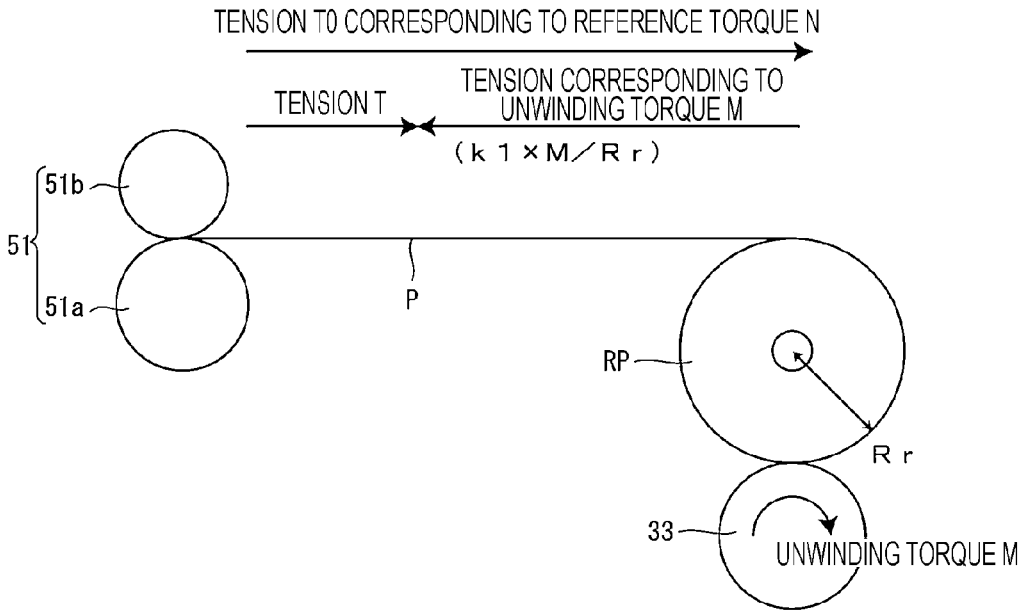
FIG. 5 is a diagram for describing a basic thought relating to a control method of a roll motor.

Based on FIG. 5, a basic thought of a control method of the roll motor 33 by the roll motor control portion 120 will be described. If the recording apparatus 10 operates only the feeding motor 53 at the time of the feeding operation, without operating the roll motor 33, the medium P is fed. In this case, tension T0 applied to the medium P between the roll body RP and the feeding roller 51 can be indicated by Expression (1) using the reference torque N which is torque of the roll motor 33 necessary for rotating the roll body RP.

$$T0=k1\times N/Rr \quad (1)$$

Moreover, k1 is a proportional constant which is determined by a reduction ratio, or the like of the roll gear train 32.

Here, in a case in which the tension T0 is great, the feeding roller 51 is idled with respect to the medium P, and the medium P cannot be fed as a desired feeding amount of feeding. Therefore, the roll motor control portion 120 generates an unwind torque M, which reduces the tension T applied to the medium P between the roll body RP and the feeding roller 51, in the roll motor 33 at the time of the feeding operation. In this case, the tension T applied to the medium P between the roll body RP and the driving roller 51*a* can be indicated by Expression (2).

$$T=k1\times(N-M)/Rr \quad (2)$$

Figure 6:
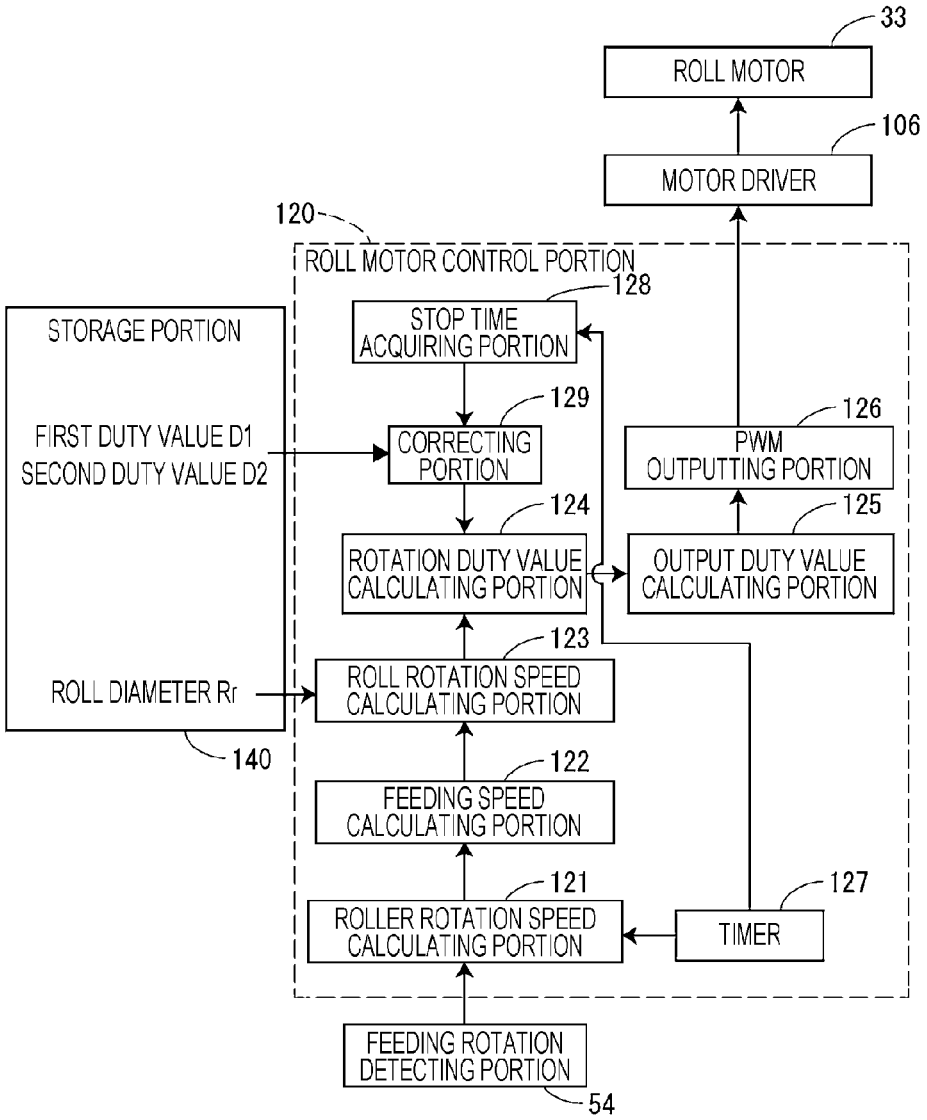
FIG. 6 is a block diagram illustrating the functional configuration of a roll motor control portion.

Based on FIG. 6, the functional configuration of the roll motor control portion 120 will be described. The roll motor control portion 120 is provided with a roller rotation speed calculating portion 121, a feeding speed calculating portion 122, a roll rotation speed calculating portion 123, a rotation duty value calculating portion 124, an output duty value calculating portion 125, a PWM outputting portion 126, and a timer 127. In addition, detail will be described later, the roll motor control portion 120 further includes a stop time acquiring portion 128 and a correcting portion 129.

The roller rotation speed calculating portion 121 calculates a rotation speed of the driving roller 51*a* based on a rotation amount of the driving roller 51*a* detected by the feeding rotation detecting portion 54, and a time measured by the timer 127.

The feeding speed calculating portion 122 calculates a feeding speed of the medium P based on a rotation speed of the driving roller 51*a* calculated by the roller rotation speed calculating portion 121 and a known diameter of the driving roller 51*a*.

The roll rotation speed calculating portion 123 calculates the rotation speed V of the roll body RP based on a feeding speed of the medium P calculated by the feeding speed calculating portion 122, and the roll diameter Rr stored in the storage portion 140.

The rotation duty value calculating portion 124 calculates the rotation duty value D corresponding to the rotation speed V calculated by the roll rotation speed calculating portion 123.

Figure 7:
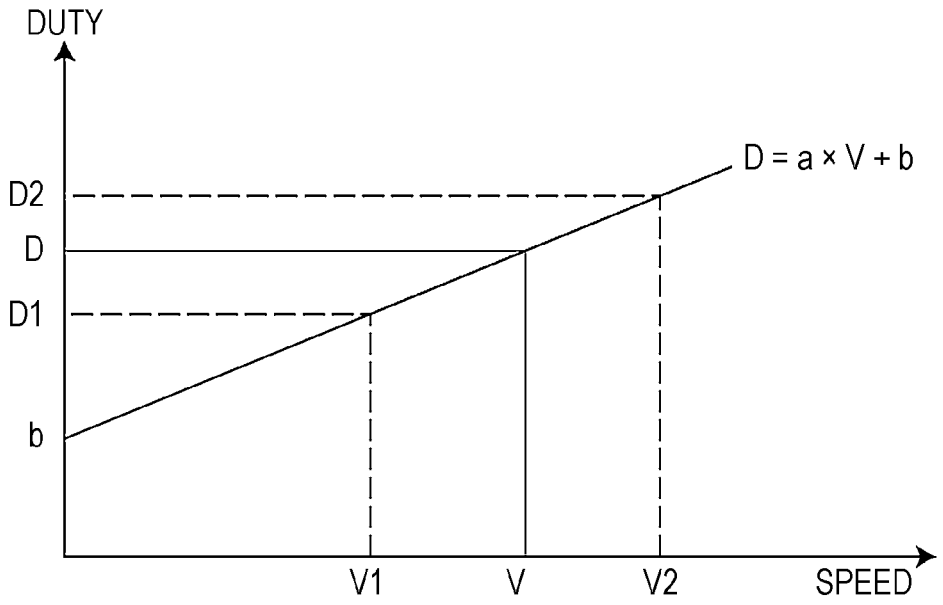
FIG. 7 is a graph illustrating a relationship of a rotation speed of a roll body and a duty value being output to the roll motor for rotating the roll body.

As illustrated in FIG. 7, the rotation duty value includes a linear corresponding relationship of the rotation speed of the roll body RP. That is, when the first duty value D1 corresponding to the first rotation speed V1 and the second duty value D2 corresponding to the second rotation speed V2 are known, an inclination a and an intercept b of an approximate curve (N=a×V+b) are determined. Therefore, the rotation duty value calculating portion 124 calculates the rotation duty value D corresponding to the rotation speed V of the roll body RP by a linear interpolation based on the first duty value D1 and the second duty value D2 stored in the storage portion 140. Moreover, detail will be described later, the first duty value D1 and the second duty value D2 stored in the storage portion 140 are corrected by the correcting portion 129 to be described later, and the rotation duty value calculating portion 124 calculates the rotation duty value D based on the corrected first duty value D1 and second duty value D2.

The output duty value calculating portion 125 calculates an output duty value Dx of the roll motor 33 by Expression (3).

$$Dx = D - \frac{\frac{Ta\times Rr}{k1}}{Ts}\times Dm \quad (3)$$

Here, Ta is a target value (target tension) of tension T according to the medium P between the roll body RP and the feeding roller 51. Ts is a starting torque of the roll motor 33. Dm is a maximum value of the duty value. Moreover, target tension Ta is stored in the storage portion 140 as a table associated with types of the medium P or target values of feeding speed of the medium P, and the like.

The PWM outputting portion 126 outputs a PWM signal of the calculated output duty value Dx to the motor driver 106. The motor driver 106 drives the roll motor 33 by PWM controlling based on the output PWM signal. Accordingly, the roll motor 33 is operated so that target tension Ta is applied to the medium P between the roll body RP and the feeding roller 51.

Figure 8:
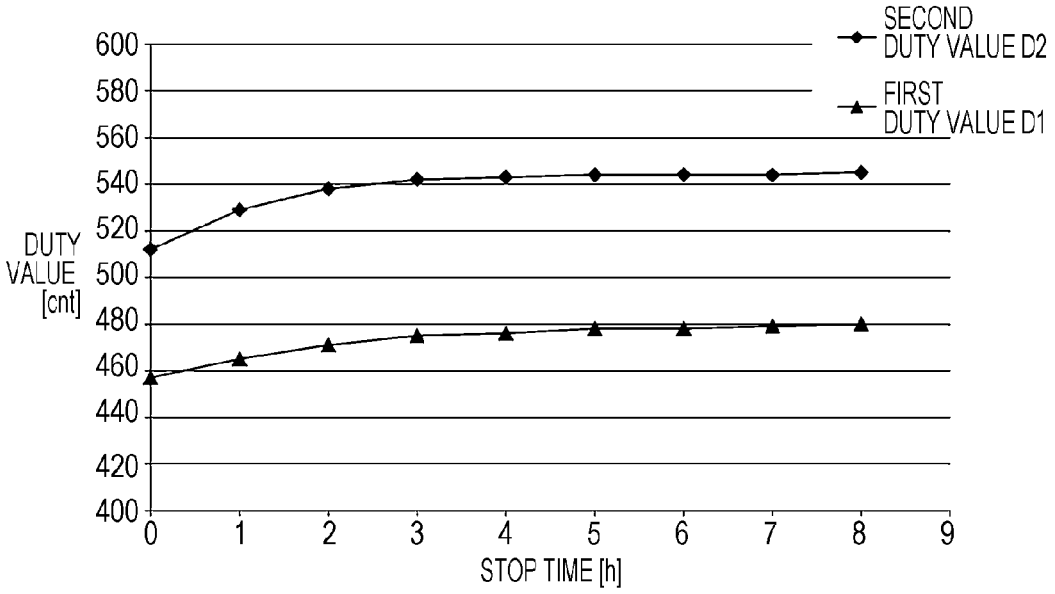
FIG. 8 is a graph illustrating a relationship of a stop time of the roll motor and a duty value being output to the roll motor for rotating the roll body.

However, as illustrated in FIG. 8, the first duty value D1 and the second duty value D2 are changed by a stop time of the roll motor 33. It is assumed that roll load, that is, load applied to the roll motor 33 at the time of rotating the roll body RP during a stop period of the roll motor 33, or characteristics of the roll motor 33 are changed, and as a result, the rotation duty value is changed. As factors causing the roll load to be changed, solidification of grease in the roll gear train 32, eccentricity of the roll body RP because the roll body RP is bent further than its own weight, and the like are considered. As factors causing characteristics of the roll motor 33 to be changed, temperature change of the roll motor 33 is considered.

Therefore, after the roll motor 33 is stopped at a long time (for example, an hour or more), in a case in which the recording job is performed, when the rotation duty value calculating portion 124 calculates the rotation duty value D using the first duty value D1 and the second duty value D2 as it is, which are measured before the roll motor 33 is stopped, a value thereof is different from a value of the rotation duty value D which is need to be originally obtained. Here, the rotation duty value D which is need to be originally obtained is a value of the rotation duty value D calculated using the first duty value D1 and the second duty value D2 obtained in a case in which the measuring process is performed again, after a stop period of the roll motor 33 is finished, and before the recording job is performed.

The calculated rotation duty value D is different from the rotation duty value D which is need to be originally obtained, appropriate tension T (target tension Ta) cannot be act on the medium P between the roll body RP and the feeding roller 51, and as a result, there is a concerned that wrinkles, meandering, scratches, printing defects, and the like are generated in the medium P. Here, in the recording apparatus 10, the first duty value D1 and the second duty value D2 are corrected based on the stop time of the roll motor 33.

Based on FIG. 6 and FIG. 9, correction of the first duty value D1 and the second duty value D2 in accordance with the stop time of the roll motor 33 will be described.

The stop time acquiring portion 128 acquires the stop time of the roll motor 33 by resetting a counter value of the timer 127 and starting counting, at the time of stopping the roll motor 33. Moreover, in the stop time acquiring portion 128, for example, a timing when the measuring process is finished, or a timing when the recording job is finished is set to a timing when the roll motor 33 is stopped.

The correcting portion 129 corrects the first duty value D1 and the second duty value D2 stored in the storage portion 140 in accordance with the stop time acquired by the stop time acquiring portion 128, and outputs the corrected value to the rotation duty value calculating portion 124.

Specifically, the correcting portion 129 acquires the first correction value and the second correction value associated with the stop time acquired by the stop time acquiring portion 128, with reference to the correction value table 150 (refer to FIG. 9), which is associated with a first correction value for correcting the first duty value D1, a second correction value for correcting the second duty value D2, and the stop time of the roll motor 33. As illustrated in FIG. 8, the correction value table 150 is created by obtaining relationship of the stop time, the first correction value, and the second correction value of the roll motor 33 when performing experiments, and the like, and the table is stored in the storage portion 140. Moreover, here, the first correction value of each stop time is equal to a difference obtained by subtracting the first duty value D1 of each stop time from the first duty value D1 at the time when the stop time is zero, but it is not limited thereto. The same manner is applied for a second correction amount. In addition, the first correction value and the second correction value are not limited to minus values, and may be plus values.

The correcting portion 129 corrects the first duty value D1 by adding the acquired first correction value to the first duty value D1 stored in the storage portion 140. In the same manner, the correcting portion 129 corrects the second duty value D2 by adding the acquired second correction value to the second duty value D2 stored in the storage portion 140. Accordingly, the correcting portion 129 changes the correction value in accordance with the rotation speed of the roll body RP. That is, the correcting portion 129 corrects the first duty value D1 and the second duty value D2 to be the first correction value and the second correction value which are different from each other.

The corrected first duty value D1 and second duty value D2 come up to the first duty value D1 and the second duty value D2 obtained in a case of being measured after a stop period of the roll motor 33 is finished. Therefore, even the rotation duty value D calculated on the basis of the corrected first duty value D1 and second duty value D2 come up to the rotation duty value D which is need to be originally obtained. Also, the roll motor control portion 120 controls the roll motor 33 based on the calculated rotation duty value D. That is, the roll motor control portion 120 controls the roll motor 33 based on the corrected first duty value D1 and second duty value D2 in accordance with the stop time of the roll motor 33. Accordingly, the appropriate tension T (target tension Ta) can be act on the medium P between the roll body RP and the feeding roller 51, and generating of wrinkles, meandering, scratches, printing defects, and the like in the medium the medium P can be suppressed.

As described above, the recording apparatus 10 of the embodiment is provided with the roll motor 33, the storage portion 140, and the roll motor control portion 120. The roll motor 33 applies torque for rotating the roll body RP to the roll body RP. The storage portion 140 stores the first duty value D1 and the second duty value D2 as a measurement result of the duty value being output to the roll motor 33 for rotating the roll body RP. The roll motor control portion 120 corrects the first duty value D1 and the second duty value D2 stored in the storage portion 140 using the first correction value and the second correction value in accordance with the stop time of the roll motor 33, and controls the roll motor 33 based on the corrected first duty value D1 and second duty value D2.

According to this configuration, the first duty value D1 and the second duty value D2 stored in the storage portion 140 are corrected using the first correction value and the second correction value in accordance with the stop time of the roll motor 33. Accordingly, the first duty value D1 and the second duty value D2 stored in the storage portion 140 can be come up to the first duty value D1 and the second duty value D2 obtained in a case of being measured after the stop period of the roll motor 33 is finished. Therefore, during the stop period of the roll motor 33, even when the rotation duty value is changed, without measuring again the duty value being output to the roll motor 33, the roll motor 33 can be appropriately operated.

In addition, in the recording apparatus 10 of the embodiment, the storage portion 140 stores the first duty value D1 and the second duty value D2 for rotating the roll body RP at the first rotation speed V1 and the second rotation speed V2 which are different from each other. The roll motor control portion 120 changes the correction value in accordance with the rotation speed of the roll body RP.

According to the configuration, the first duty value D1 and the second duty value D2 stored in the storage portion 140 are corrected to be the first correction value and the second correction value in accordance with the rotation speed of the roll body RP. Accordingly, even when a change range of the rotation duty value changed in the stop period of the roll motor 33 differs according to the rotation speed of the roll body RP, the first duty value D1 and the second duty value D2 stored in the storage portion 140 can be come up to the first duty value D1 and the second duty value D2 obtained in a case of being measured after the stop period of the roll motor 33 is finished.

Moreover, the roll motor 33 is an example of a "roll driving portion". The duty value being output to the roll motor 33 is an example of an "output value to the roll driving portion. As the "output value to the roll driving portion", in addition to the duty value being output to the roll motor 33, a current value being output to the roll motor 33 and a torque value being output to the roll motor 33 may be used. The roll motor control portion 120 is an example of a "the roll control portion". The first duty value D1 and the second duty value D2 are an example of an "output measured value". The first correction value and the second correction value are an example of the "correction value".

The invention is not limited to the above described embodiment, and it is needless to say that various configuration can be adopted hereto in a range without departing from a purpose of the invention. For example, the embodiment can be changed to an embodiment as follows.

Based on FIG. 10, the first modification example of the embodiment will be described. The roll motor control portion 120 may change the first correction value and the second correction value in accordance with a weight of the roll body RP. Specifically, as illustrated in FIG. 10, the storage portion 140 stores data associated with a plurality of types (for example, two types of less than W [kg] and equal to or more than W [kg]) of in each weight of the roll body RP, the first correction value and the second correction value, and the stop time of the roll motor 33, as the correction value table 150*a*. Moreover, here, in a case in which the weight of the roll body RP is great, when compared to a case in which the weight of the roll body RP is light, the correction amount (absolute value of first correction value and second correction value) becomes great, but it is not limited thereto. In addition, a difference between a correction value in a case in which the weight of the roll body RP is great and a correction value in a case in which the weight of the roll body RP is light, may be different among the plurality of stop time, and may be the same as each other. Also, with reference to the correction value table 150*a*, the correcting portion 129 acquires the first correction value and the second correction value associated with the stop time in accordance with the weight of the roll body RP acquired, for example, on the basis of operation with respect to an operation panel.

According to the configuration, the first duty value D1 and the second duty value D2 stored in the storage portion 140 are corrected to the first correction value and the second correction value in accordance with the weight of the roll body RP. Accordingly, in a case in which the change range of the rotation duty value changed in the stop period of the roll motor 33 differs according to the weight of the roll body RP, the first duty value D1 and the second duty value D2 stored in the storage portion 140 can be come up to the first duty value D1 and the second duty value D2 which are obtained in a case of being measured after the stop period of the roll motor 33 is finished.

Based on FIG. 11, a second modification example of the embodiment will be described. The roll motor control portion 120 may change the first correction value and the second correction value in accordance with a change amount of a temperature of the roll motor 33 at the time of staring measuring the first duty value D1 and the second duty value D2. Specifically, as illustrated in FIG. 11, the storage portion 140 stores data associated with a plurality of types (for example, as amount of increasing of temperature, two types of less than t [° C.] and equal to or more than t [° C.]) in every change of the temperature of the roll motor 33, the first correction value and the second correction value, and the stop time of the roll motor 33, as the correction value table 150*b*. Moreover, here, in a case in which the amount of increasing of temperature is great, when compared to a case in which the amount of increasing of temperature is small, the correction amount (absolute value of first correction value and second correction value) becomes great, but it is not limited thereto. In addition, a difference between a correction value in a case in which the amount of increasing of temperature of the roll body RP and a correction value in a case in which the amount of increasing of temperature of the roll body RP is small may be differed in the plurality of stop time, and may be the same. Also, with reference to the correction value table 150*b*, the correcting portion 129 acquires the first correction value and the second correction value associated with the stop time in accordance with the amount of change of temperature of the roll motor 33 acquired on the basis of a detection result by, for example, a temperature sensor.

According to the configuration, the first duty value D1 and the second duty value D2 stored in the storage portion 140 are corrected to the first correction value and the second correction value in accordance with the amount of change of temperature of the roll motor 33. Accordingly, even when the change range of the rotation duty value changed during the stop period of the roll motor 33 differs according to the amount of change of temperature of the roll motor 33, the first duty value D1 and the second duty value D2 can be come up to the first duty value D1 and the second duty value D2 obtained in a case in which the first duty value D1 and the second duty value D2 stored in the storage portion 140 are measured after the stop period of the roll motor 33 is finished.

Moreover, the roll motor control portion 120 may change the first correction value and the second correction value in accordance with both of the weight of the roll body RP and the amount of change of temperature of the roll motor 33.

In the first modification example and the second modification example according to the embodiment, the number of the rotation duty value being corrected by the roll motor control portion 120 is not limited two, and may be one, or may be three or more. For example, at the time of feeding operation, in a case in which the medium P is fed always at the same feeding speed, it is satisfied that there is the rotation duty value D in correlation with the rotation speed of the roll body RP V corresponding to that speed. In this case, the roll motor control portion 120 may correct the one rotation duty value D.

As an application example of the medium feeding apparatus of the invention, it is not limited to an ink jet manner recording apparatus, and for example, may be a dot impact manner recording apparatus, and may be an electronic photographic recording apparatus. Further, it is not limited to a recording apparatus, and for example, the medium feeding apparatus of the invention may be applied for a drying apparatus performing a dry process on a medium while the medium is fed, or may be applied for a surface processing apparatus performing a surface process on the medium while the medium is fed. In addition, it is not limited to an apparatus performing such a process on the medium, and it does not matter that the apparatus may be an apparatus simply feeding media.

This application claims priority under 35 U.S.C. § 119 to Japanese Patent Application No. 2016-058112, filed Mar. 23, 2016. The entire disclosure of Japanese Patent Application No. 2016-058112 is hereby incorporated herein by reference.

What is claimed is:

1. A medium feeding apparatus comprising:

a roll driving portion that applies torque for rotating a roll body around which a medium is wound to the roll body;

a storage portion that stores an output measured value which is a measurement result of an output value to the roll driving portion for rotating the roll body; and a roll control portion that corrects the output measured value stored in the storage portion to a correction value in accordance with a length of time while a rotation of the roll driving portion is stopped, and controls the roll driving portion based on the corrected output measured value, wherein the roll control portion changes the correction values in accordance with an amount of change of temperature of the roll driving portion after the output measured values are measured.

2. The medium feeding apparatus according to claim 1, wherein the storage portion stores a plurality of the output measured values for rotating the roll body at each different rotation speed, and wherein the roll control portion changes the correction values in accordance with the rotation speed of the roll body.

3. The medium feeding apparatus according to claim 1, wherein the roll control portion changes the correction values in accordance with the weight of the roll body.

* * * * *